US007712421B2

(12) United States Patent
Hartel et al.

(10) Patent No.: US 7,712,421 B2
(45) Date of Patent: May 11, 2010

(54) PALLET

(75) Inventors: Marc Andreas Hartel, Reiskirchen (DE); Deane Harder, Freiburg (DE); Markus Milwich, Reutlingen (DE); Henrique Monnerat, Frankfurt (DE); Thomas Speck, Schallstadt-Mengen (DE)

(73) Assignee: Rittal GmbH & Co., KG, Herborn (DE)

( * ) Notice: Subject to any disclaimer, the term of this patent is extended or adjusted under 35 U.S.C. 154(b) by 275 days.

(21) Appl. No.: 11/891,066

(22) Filed: Aug. 8, 2007

(65) Prior Publication Data

US 2008/0250987 A1 Oct. 16, 2008

(30) Foreign Application Priority Data

Apr. 11, 2007 (DE) ..... 10 2007 017 151

(51) Int. Cl.
*B65D 19/00* (2006.01)

(52) U.S. Cl. ..... 108/56.3; 108/51.11

(58) Field of Classification Search ..... 108/51.11, 108/56.1, 56.3, 57.22, 57.31, 57.33
See application file for complete search history.

(56) References Cited

U.S. PATENT DOCUMENTS 2,652,219 A * 9/1953 Arthur ..... 108/57.14
2,918,190 A * 12/1959 Martin ..... 220/4.28
3,181,659 A * 5/1965 Kohl ..... 52/783.18
3,835,791 A * 9/1974 Brown ..... 108/56.1
5,197,395 A * 3/1993 Pigott et al. ..... 108/56.1
5,197,396 A * 3/1993 Breezer et al. ..... 108/56.3

FOREIGN PATENT DOCUMENTS

DE 36 12 647 A1 10/1987
DE 299 09 001 U1 9/1999
JP 07329969 A 12/1995

OTHER PUBLICATIONS

Co-Pending U.S. Appl. No. 11/891,051, filed Aug. 8, 2007.

* cited by examiner

*Primary Examiner*—Janet M Wilkens
(74) *Attorney, Agent, or Firm*—Pauley Peterson & Erickson

(57) ABSTRACT

A pallet for receiving and transporting loads, having an upper platform for receiving the loads, and a substructure, which supports the upper platform and is constructed of an upper part and a lower part and several support members inserted between them. A good shock absorption, along with a rugged construction, is achieved because the support members each is of a held-together bundle of spike-like individual elements, which extend between the upper part and the lower part, can be laterally deflected with respect to each other and have damping properties.

19 Claims, 3 Drawing Sheets

PALLET

BACKGROUND OF THE INVENTION

1. Field of the Invention

This invention relates to a pallet for receiving and transporting loads, having an upper platform for receiving the loads, and a substructure, which supports the upper platform and is constructed of an upper part and a lower part and several support members therebetween inserted.

2. Discussion of Related Art

A pallet is disclosed in German Patent Reference DE 36 12 647 A1. Individual ones, or all components of this pallet, on which packages to be stored or transported are received on support decks attached to a support substructure, have been produced from comminuted fiber waste material, with plastic as a binder, to obtain a budget-priced, weather-resistant pallet with a long service life. However, such pallets often do no have a sufficient shock-absorbing capability for the goods to be transported.

German Patent Reference DE 299 09 001 U1 shows pallets with a substructure of interspersed blocks, on which a receiving platform is placed. As reinforcement, the interspersed blocks have fiber mats or a bi-axially stretched thermoplastic material, if required with additives, which are also cost-effective and can be recycled. With these pallets, the absorption of shocks is often not sufficient.

SUMMARY OF THE INVENTION

One object of this invention is to provide a pallet of the type mentioned above but which has an improved shock-absorbing effect.

This object is attained by a pallet having characteristics taught in this specification and in the claims. The support members each are of a held-together bundle of spike-like individual elements, which extend between the upper part and the lower part, which can be laterally deflected with respect to each other and which have damping properties. The support members, which assure a sufficient support strength for the loads to be received, will yield if sudden shocks occur, for example when the pallets are put down. Thus it is also possible to prevent vibrations. As a bundle, the spike-like or small rod-like individual elements for one act as good supports and, because of their spreading effect toward their end sections or by bulging in their center area are sufficiently resilient, in case of excessive forces, to absorb a shock, for example resulting from the spines of a hedgehog.

Great stability, along with dependable functioning ability can be accomplished because at locations which are vertically spaced apart from each other in the position of use, the upper part has hollowed-out spaces on an underside and the lower part has hollowed-out spaces on a top, into which the end sections of the bundles are inserted.

Here an advantageous construction results if the hollowed-out spaces have a hood-shaped curvature. An advantageous support also results from the hood-shaped or convex curvature oriented outward with respect to the linear extension of the bundles of small rods.

The steps, wherein the upper part and the lower part are connected with each other at intersecting points where the support members are arranged, also contribute to a stable construction, along with dependable functioning. Also, the upper part and the lower part can be connected with each other by elastic or flexible or movably suspended elements, so that they are securely kept together.

A construction which is advantageous regarding the way of functioning of the support elements if the bundles of the spike-like individual elements are kept together by a bundling ring. In this connection, the bundling ring provides good spreading possibilities for the individual elements in the direction toward their end sections or, in case of an elastic embodiment of the bundling ring in the center area and, when elastically embodied, the bundling ring itself can assist the damping properties, or shock absorption.

In one advantageous construction the upper part and the lower part are held together by the bundling rings, wherein the bundling rings permit a vertical movement of the upper part and the lower part relative to each other. In this case, the bundling ring can itself be elastically designed and/or permit a relative movement between the upper part and the lower part, also in the vertical direction.

It is possible to achieve a stable, yet still shock-damping, embodiment if the underside of the lower part is supported on a base, and/or the top of the upper part is supported against a receiving plate by support sections which spread in the manner like tree roots. In this case, the support sections spread in a funnel shape or finger shape conically with respect to the base or toward the receiving plate.

The steps wherein the support sections are vertically positioned below or above the bundles also contribute to an advantageous construction and good functioning.

A stable construction with advantageous transport possibilities, for example by forklifts, results from the upper part having upper longitudinal struts and transverse struts, in whose connecting points the support members are installed, and the lower part has lower longitudinal struts extending under the upper longitudinal struts, with which the support members are connected.

Steps, wherein the upper and lower longitudinal struts, diagonal struts, and possibly diagonal struts on the upper part, have a lightweight construction in the form of a skeleton, contribute to stability. The skeleton principle results in great stability, along with lightweight construction and a relatively low requirement for materials.

Manufacture, retooling and possibly simple repairs are possible if the upper part has holding elements for the tool-free attachment of the upper platform.

BRIEF DESCRIPTION OF THE DRAWINGS

This invention is explained in greater detail in view of exemplary embodiments, making reference to the drawings, wherein.

DETAILED DESCRIPTION OF THE INVENTION

Figure 1:
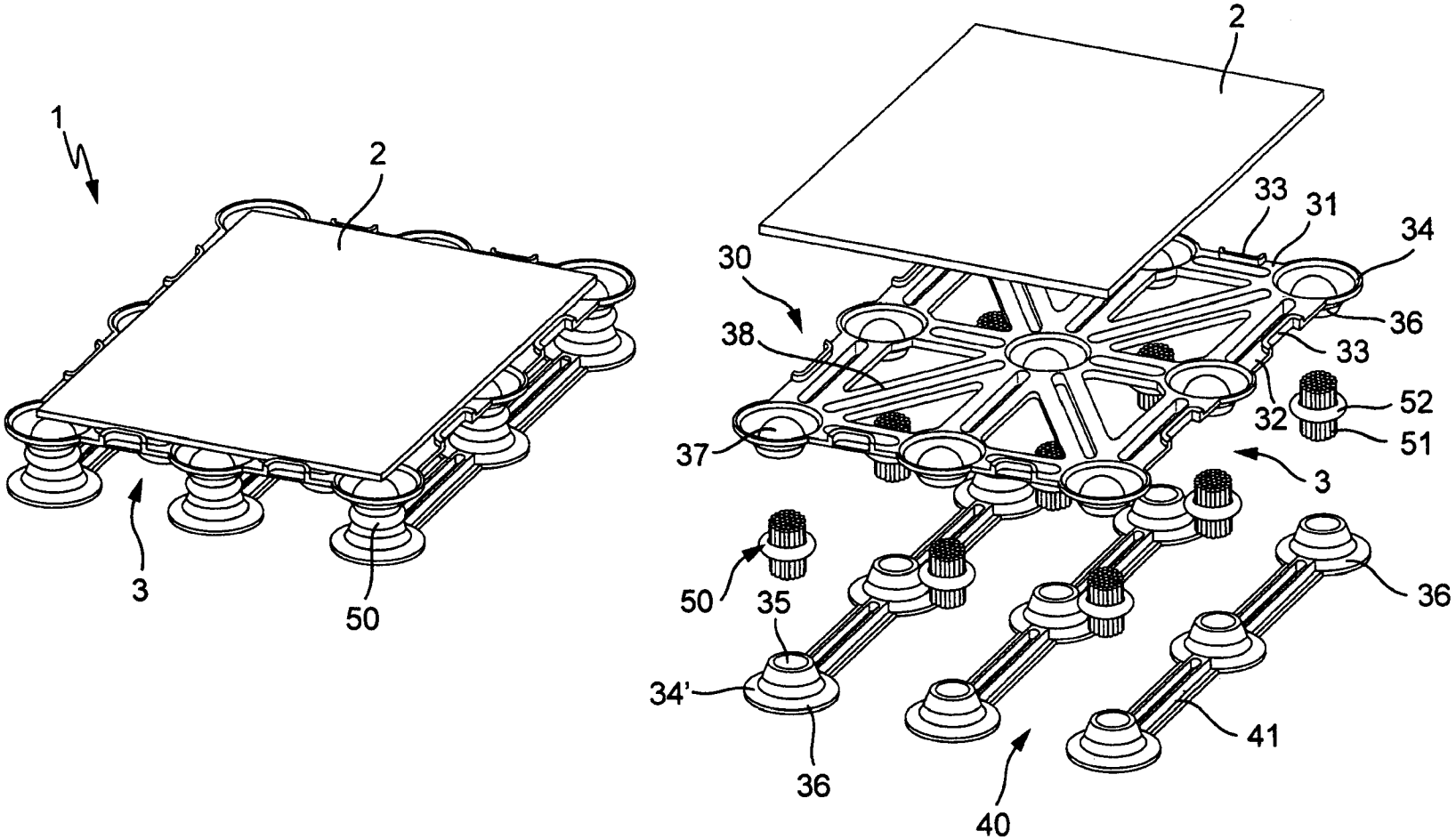
FIG. 1 shows a pallet with a receiving plate and a substructure in a perspective plan view, in an assembled and an exploded state.

A pallet 1 with a substructure 3 and a receiving plate 2 for packages is shown in FIG. 1, in the assembled state and also in an exploded state. For example, the receiving plate 2 is made of a recyclable composite fiber material of natural fibers or of wood, for example as a closed plate or as a plate-like strut construction. In a view from above, the pallet 1 can be rectangular or square.

The substructure 3 is put together from an upper part 30 and a lower part 40, with support members 50 interspersed at intersection points, inclusive of the corner areas. The upper part 30 has horizontal struts arrangements of longitudinal struts 32 and transverse struts 31 extending at right angles with them wherein, in the example shown, two lateral longitudinal struts 32 and one further longitudinal strut extending centered and parallel with respect to them, as well as two lateral transverse struts 31 and a center transverse strut extending centered and parallel with respect to them, are connected with each other at their intersection points. Furthermore, diagonal struts 38 extend between the corner points and are also connected with the transverse struts 31 and the longitudinal struts 32. In the present case, the longitudinal struts 32 are wider and more sturdy than the transverse struts 31 and diagonal struts 38. The longitudinal struts 32, the transverse struts 31 and the diagonal struts 38 are made in lightweight construction in the form of a skeleton, a skeleton principle, and connected in order to obtain the greatest possible stability with the least possible use of material. At the outer edge of the lateral longitudinal struts 32 and transverse struts 31, two holding elements are formed which, for example, are spaced apart from each other and upwardly oriented, which partially enclose the receiving plate 2 at the edge and hold it by a clamping effect, snap-in effect or by a locked-in connection without requiring tools. In a similar way, it is also possible for other holding elements to be arranged over the length of the transverse struts 31, the longitudinal struts 32 and/or the diagonal struts 38, which work together with counter-elements of the receiving plates 2.

Upper support sections 34 are inserted, for example formed-on in one piece or fixed in place as separate elements, at the intersection points of the longitudinal struts 32 and the transverse struts 31, and have hollowed-out spaces 35 for the support members 50, which are open toward the bottom and are closed off toward the top, in a hood shape. The hollowed-out spaces 35, which are convex toward the top, are surrounded by support elements, or support feet 36, which open upward in a funnel shape and on which the receiving plate 2 is supported, similar to a tree root principle. This shaping of the support sections 34 results in a structure which is advantageous for shock dampening.

The lower part 40 has lower longitudinal struts 41 extending parallel underneath the upper longitudinal struts 32, on which lower support sections 34' are formed or fixed in place underneath the support sections 34. In this way, interspaces extending in the longitudinal direction result between the lateral longitudinal struts 41 and the center longitudinal strut, between which the pickup forks of a forklift, for example, can be inserted. For example, the lower longitudinal struts 41 have the same cross-sectional profile as the upper longitudinal struts 32. In this case, the lower support sections 34' are shaped corresponding to the upper support sections 34, but point downward with a section which widens in a funnel shape in order to be supported, in accordance with the tree root principle, on the base and to also assist in the absorption of shocks. Corresponding to the upwardly convex hollowed-out spaces 35 with their convex arching 37, the lower support sections 34' have downwardly convex, or hood-shaped hollowed-out spaces 35.

Figure 2:
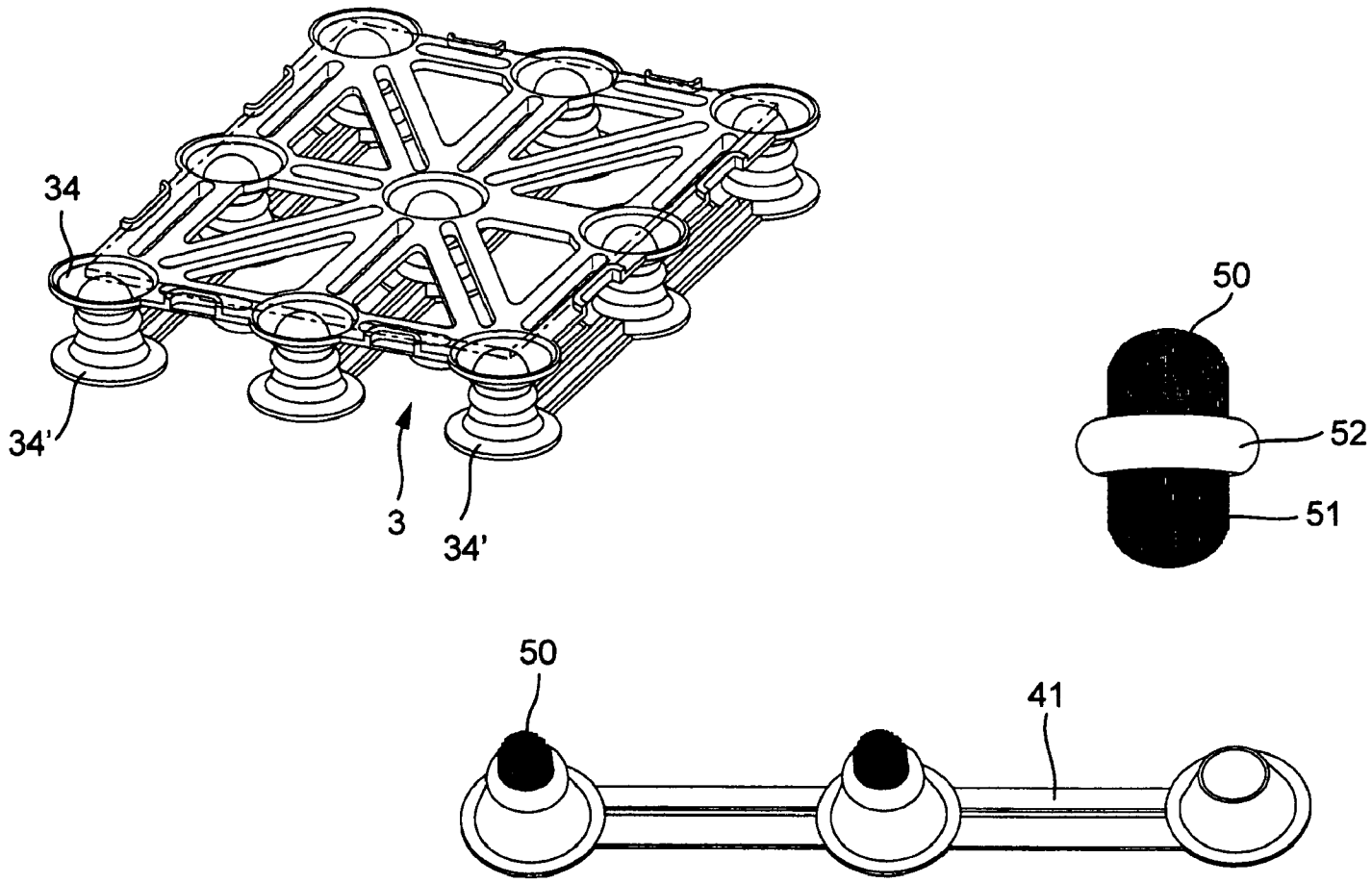
FIG. 2 shows a further representation of a pallet with a substructure and parts thereof, in a perspective plan view.

With their end sections, the support members 50 are inserted on the one side into the hollowed-out spaces 35 of the lower support sections 34' and on the other side into the hollowed-out spaces 35 of the upper support sections 34, which can be seen more clearly in the lower representation in FIG. 2, in particular. Each support member 50 comprises a bundle 51 of spike-like small rods, wherein the ends of the bundles are rounded, similar to the assigned hollowed-out spaces 35. The "spike bundles" are held together by a center circumferential ring which, in the assembled state of the upper part 30 and lower part 40, is arranged between the facing end areas of the support sections 34, 34'. In this case, there is a certain amount of play in the hollowed-out spaces 35, which makes it possible for the spike-like small rods to spread in the direction toward the end sections and in the process to be supported on the respective facing inner wall of the hollowed-out spaces 35. Alternatively, or additionally, the design can be such that the spike-like small rods spread in the center relatively to each other, wherein the bundling ring 52 is resilient and counters the spreading by its elastic force. The small rods themselves also have a certain amount of resilience for spreading in the center. With this design and by the insertion of the support members 50, shock damping results in case of sudden setting-down of the pallets or during transport, while on the other hand large support forces are assured.

As FIG. 2 shows, the receiving plate 2 itself can be designed as a strut structure. Also, the top of the upper part 30 can be the receiving platform. The longitudinal struts 32, 41, or also the further struts, can for example be formed from two parallel rods which are spaced apart from each other and which are connected as one piece in the area of or near the support sections 34, 34'.

Figure 3:
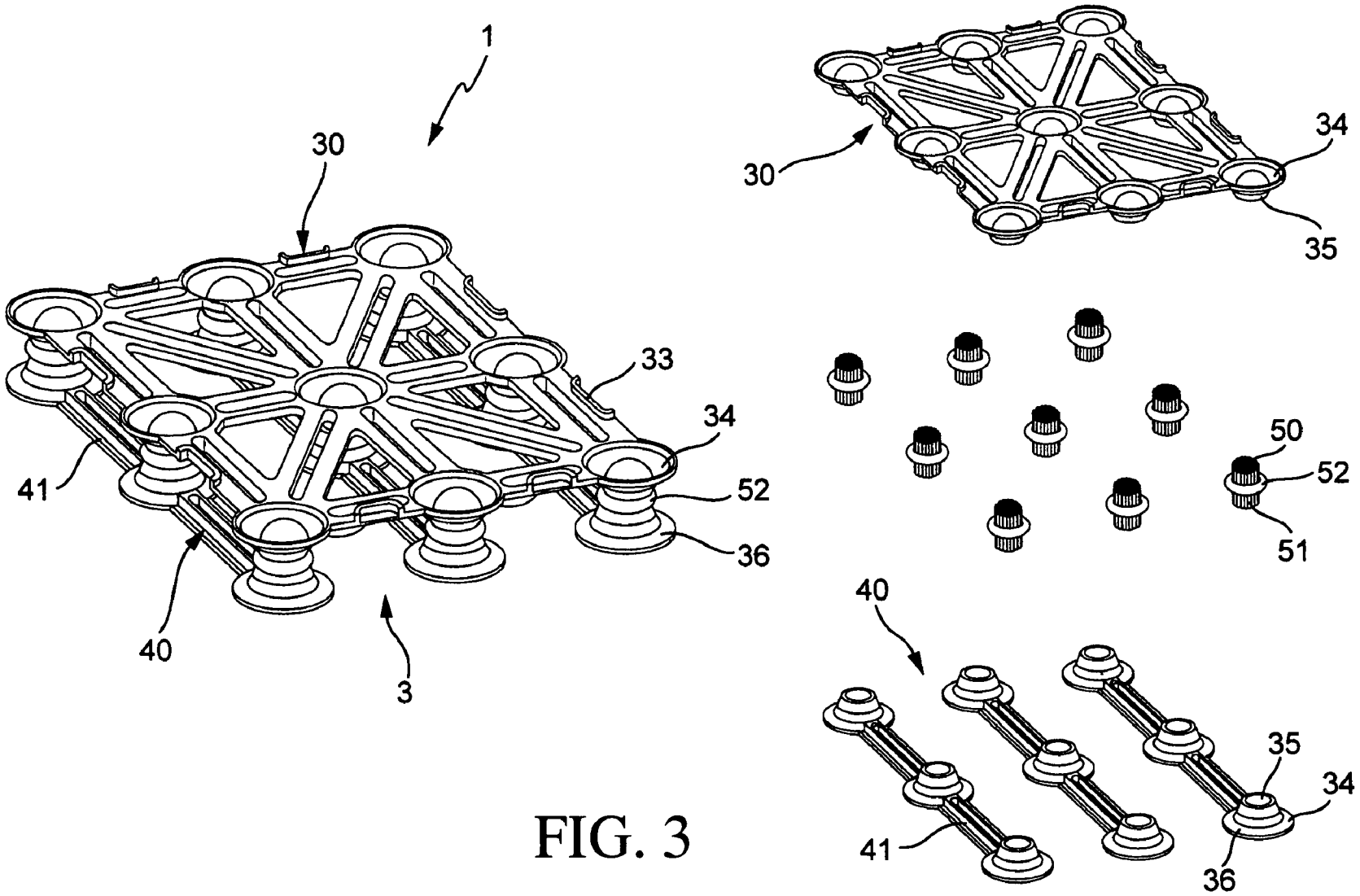
FIG. 3 shows a further representation of a pallet in a perspective plan view, in an assembled and exploded state.

FIG. 3 also shows a pallet 1 in an assembled representation and in an exploded representation, wherein the receiving plate 2 is omitted in contrast to FIG. 1.

As the representations in accordance with FIGS. 1, 2 and 3 further show, the support sections 34, 34' with the support members 50 inserted are arranged evenly distributed over the surface of the pallet, wherein support sections with support members 50 are arranged at the corners, in the center of the lateral edges, as well as in the center of the pallet. Advantageously, the bundling ring 52 can be resilient and on its part contributes to shock absorption. The upper part 30 and the lower part 40 are for example connected by the bundling rings 52 and/or by intermediate elements, which for example are designed elastically or flexibly or movably with links in the manner of a chain and prevent the falling apart of the upper part 30 and the lower part 40.

German Patent Reference 10 2007 017 151.1, the priority document corresponding to this invention, and its teachings are incorporated, by reference, into this specification.

What is claimed is:

1. A pallet for receiving and transporting loads, having a receiving plate (2) for receiving the loads, and a substructure (3) which supports the receiving plate (2) and is constructed of an upper part (30) and a lower part (40) and several support members (50) therebetween inserted, the pallet comprising:

the support members (50) each composed of a held-together bundle (51) of individual rods, which extend between the upper part (30) and the lower part (40), which can be laterally deflected with respect to each other and which have damping properties, at locations vertically spaced apart from each other in the position of use, the upper part (30) having hollowed-out spaces (35) on an underside and the lower part (40) having the hollowed-out spaces (35) on a top, into which end sections of the bundles (51) are inserted, and the hollowed-out spaces (35) having a hood-shaped curvature.

2. The pallet in accordance with claim 1, wherein the upper part (30) and the lower part (40) are connected with each other at intersecting points where the support members (50) are arranged.

3. The pallet in accordance with claim 2, wherein the bundles (51) of the individual rods are maintained together by a bundling ring (52).

4. The pallet in accordance with claim 3, wherein the upper part (30) and the lower part (40) are held together by the bundling rings (52), wherein the bundling rings (52) permit a vertical movement of the upper part (30) and the lower part (40) with respect to each other.

5. The pallet in accordance with claim 4, wherein at least one of the underside of the lower part (40) is supported on a base and the top of the upper part (30) is supported against the receiving plate (2) by support sections (34, 34') which spread in a roots manner.

6. The pallet in accordance with claim 5, wherein the support sections (34, 34') are vertically positioned one of below and above the bundles (51).

7. The pallet in accordance with claim 6, wherein the upper part (30) has upper longitudinal struts (32) and transverse struts (31), in whose connecting points the support members (50) are installed, and the lower part (40) has lower longitudinal struts (41) extending under the upper longitudinal struts (32), with which the support members (50) are connected.

8. The pallet in accordance with claim 7, wherein at least one of the upper and lower longitudinal struts (32, 41), and diagonal struts (38) on the upper part (30), are of a lightweight construction in a form of a skeleton.

9. The pallet in accordance with claim 8, wherein the upper part (30) has holding elements (32) for the tool-free attachment of the receiving plate (2).

10. The pallet in accordance with claim 1, wherein at least one of an underside of the lower part (40) is supported on a base and the top of the upper part (30) is supported against the receiving plate (2) by support sections (34, 34') which spread in a roots manner.

11. The pallet in accordance with claim 1, wherein the upper part (30) has upper longitudinal struts (32) and transverse struts (31), in whose connecting points the support members (50) are installed, and the lower part (40) has lower longitudinal struts (41) extending under the upper longitudinal struts (32), with which the support members (50) are connected.

12. The pallet in accordance with claim 1, wherein the upper part (30) has holding elements (32) for the tool-free attachment of the receiving plate (2).

13. A pallet for receiving and transporting loads, having a receiving plate (2) for receiving the loads, and a substructure (3) which supports the receiving plate (2) and is constructed of an upper part (30) and a lower part (40) and several support members (50) therebetween inserted, the pallet comprising:

the support members (50) each composed of a held-together bundle (51) of individual rods, which extend between the upper part (30) and the lower part (40), which can be laterally deflected with respect to each other and which have damping properties, at least one of an underside of the lower part (40) supported on a base and the top of the upper part (30) supported against the receiving plate (2) by support sections (34, 34') which spread in a roots manner, and the support sections (34, 34') vertically positioned one of below and above the bundles (51).

14. The pallet in accordance with claim 13, wherein at locations which are vertically spaced apart from each other in the position of use, the upper part (30) has hollowed-out spaces (35) on an underside and the lower part (40) has the hollowed-out spaces (35) on a top, into which end sections of the bundles (51) are inserted.

15. The pallet in accordance with claim 14, wherein the hollowed-out spaces (35) having a hood-shaped curvature.

16. The pallet in accordance with claim 13, wherein the upper part (30) and the lower part (40) are connected with each other at intersecting points where the support members (50) are arranged.

17. The pallet in accordance with claim 16, wherein the bundles (51) of the individual rods are maintained together by a bundling ring (52).

18. The pallet in accordance with claim 17, wherein the upper part (30) and the lower part (40) are held together by the bundling rings (52), wherein the bundling rings (52) permit a vertical movement of the upper part (30) and the lower part (40) with respect to each other.

19. A pallet for receiving and transporting loads, having a receiving plate (2) for receiving the loads, and a substructure (3) which supports the receiving plate (2) and is constructed of an upper part (30) and a lower part (40) and several support members (50) therebetween inserted, the pallet comprising:

the support members (50) each composed of a held-together bundle (51) of individual rods, which extend between the upper part (30) and the lower part (40), which can be laterally deflected with respect to each other and which have damping properties, the upper part (30) having upper longitudinal struts (32) and transverse struts (31), in whose connecting points the support members (50) are installed, and the lower part (40) having lower longitudinal struts (41) extending under the upper longitudinal struts (32), with which the support members (50) are connected, and at least one of the upper and lower longitudinal struts (32, 41), and diagonal struts (38) on the upper part (30), are of a lightweight construction in a form of a skeleton.

* * * * *